US005373582A

United States Patent [19]

Dragone et al.

[11] Patent Number: 5,373,582

[45] Date of Patent: Dec. 20, 1994

[54] BODY ARMOR PANEL

[75] Inventors: Gaeton J. Dragone, Croton Falls; Anthony J. Borgese, Lake Ronkonkoma; Brad J. Ditchfield, Farmingdale, all of N.Y.

[73] Assignee: Point Blank Body Armor, Inc., Amityville, N.Y.

[21] Appl. No.: 962,281

[22] Filed: Oct. 16, 1992

[51] Int. Cl.[5] ..... A41D 13/00

[52] U.S. Cl. ..... 2/2.5; 2/102; 2/94

[58] Field of Search ..... 2/2, 2.5, 102, 94, 267, 2/49.1, 49.4, 52, 412, 267, 421; 224/209, 264; 450/86

[56] References Cited

U.S. PATENT DOCUMENTS

| | | | |
|---|---|---|---|
| 3,557,384 | 1/1969 | Barron et al. . | |
| 3,559,210 | 5/1969 | Hansen . | |
| 4,183,097 | 1/1980 | Mellian | 2/2.5 |
| 4,413,357 | 11/1983 | Sacks | 2/2.5 |
| 4,660,223 | 4/1987 | Fritch . | |
| 4,697,285 | 10/1987 | Sylvester | 2/2.5 |
| 4,989,266 | 2/1991 | Borgese et al. . | |

FOREIGN PATENT DOCUMENTS

| | | |
|---|---|---|
| 2130073 | 5/1984 | United Kingdom . |
| 2231481 | 11/1990 | United Kingdom . |

*Primary Examiner*—Clifford D. Crowder
*Assistant Examiner*—Gloria Hale
*Attorney, Agent, or Firm*—McAulay, Fisher, Nissen, Goldberg & Kiel

[57] ABSTRACT

A body armor panel has integral receivers disposed intermediate the multiple ballistic layers of the panel at the side and shoulder portions thereof. Resilient straps extend from the receivers, and have separable fasteners on the ends thereof for attachment to complimentary fasteners on a wearer's body. Using resilient straps, anchored in and extending from both the shoulders and sides allows the armor panel to be tensioned around its periphery, thus causing the armor panel to substantially keep its shape and surface area protection after successive impacts, as the resilient straps counteract the drawing in of the ballistic layers after each impact. Multiple linear stitching is used to attach each receiver within the armor panel to reduce susceptibility to ballistic impacts and to allow contouring of the side and shoulder portions to a body shape.

15 Claims, 6 Drawing Sheets

BODY ARMOR PANEL

TECHNICAL FIELD

This invention relates to body armor panels and more particularly to multi-layer body armor panels having integral means for tensioning the panel to assure substantial shape recovery after successive ballistic impacts.

BACKGROUND

Various body armor panels are known in the art. For example, in U.S. Pat. No. 4,989,266, a multi-layer panel is disclosed which incorporates interleaf sheets of materials for preventing projectile penetration. These layers are typically stitched together to form an integral body armor panel which is then inserted into a garment shell which acts as a carrier for the panel. Such panels typically cover the chest and back areas, and may have projecting side and shoulder portions.

In U.S. Pat. No. 5,073,985, a garment shell is described which simulates a uniform garment. The shell has pockets within which body armor panels may be disposed and additionally includes integral fasteners for securing front and rear portions of the garment shell to the body.

In U.S. Pat. No. 4,697,285, a flexible body armor panel is disclosed which has no stitching through the ballistic layers except at designated portions along the sides where side fasteners are attached. The fasteners are placed on an outer surface of the panel, with a single stitch extending through all the layers of the panel inboard of the panel side edges. The stitch is used to attach the fasteners to the outer portion of the panel and is the sole means for keeping the layers in register, providing a maximum flexibility armor panel.

The use of body armor containing garments has become more widespread, particularly by law enforcement professionals. Generally, body armor design efforts, as the caliber and grain of the ballistic threat has increased, have correspondingly been directed towards improved resistance to projectile penetration. However, more sophisticated weapons with rapid multiple shot capability, i.e. semi and fully automatic rifles and hand guns, have become increasingly available, adding a new threat to body armor wearers.

With conventional body armor placed in carriers, the fasteners extend from the carrier, rather than the body armor panel. Thus, the integral armor panels located in front and rear pockets may float somewhat on the chest and back. While such panels are successful in resisting impacts, there is a tendency towards displacement of the ballistic layers inwardly to the point of impact. It has been found that with successive impacts, there is a gradual shrinkage of the area of coverage of the panel. Thus, successive impacts reduce the protection of the garment by reducing the area of coverage. Consequently, the ability to resist multiple impacts without exposing additional body area has become a new area of concern.

For example, while the panel in U.S. Pat. No. 4,697,285, discloses side fasteners extending from inboard portions of the panel itself, the outer attachment of the fasteners is vulnerable to direct impact damage. Also, thread breakage is more likely to occur from indirect impacts since the single side stitch is the sole means for keeping the layers in register. Thus, upon impact, these stitches are subjected to very high forces when the layers pull inwardly to the point of impact against the fasteners. Also, the shoulder fasteners are non-resilient and are not restrained by through stitching which may result in downward displacement onto the stomach with successive impacts to the body armor panel, thus exposing the upper chest.

SUMMARY OF THE INVENTION

It is a object of the present invention to provide a body armor panel resistant to displacement upon successive impacts.

It is a further object to provide a body armor panel having means for tensioning the panel in at least four separate areas about the periphery of the garment, to cause substantial return of the panel shape after impact.

It is yet another object of the present invention to provide integral fasteners, sandwiched within the ballistic layers used to produce the body armor panel, to reduce susceptibility to impact damage and enhance resistance to panel shrinkage after successive impacts.

These and other objects of the present invention are achieved by providing a body armor panel comprising multiple layers of ballistic resistant material, the panel having projecting side portions and shoulder portions, resilient strap means located at the side and shoulder portions, and having first ends integral with the ballistic layers and disposed intermediate thereof and second ends extending from the panel to tension the armor panel sufficiently to provide substantial return to its original shape after impact. First attachment means are located at the side and shoulder portions for securing the resilient strap means within the multiple ballistic layers. Fastener means are attached to the second strap ends and are matable with complementary fasteners for securing the panel to a wearer's body.

Utilizing the inventive body armor panel, multiple successive impacts can be absorbed by the body armor panel while the tensioned resilient straps assure that after each impact, the protective layers snap back substantially to their previous shade to prevent reduced coverage over the upper chest, sides or back of the person wearing the armor.

BRIEF DESCRIPTIONS OF THE DRAWINGS

Figure 11A:
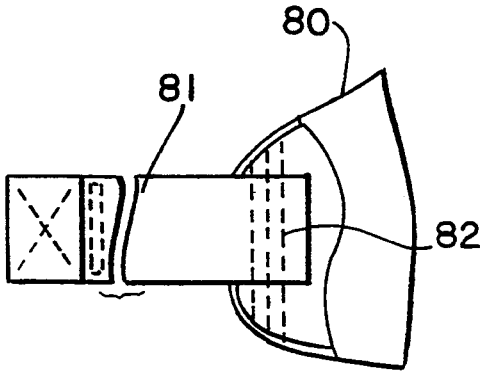
Figure 11B:
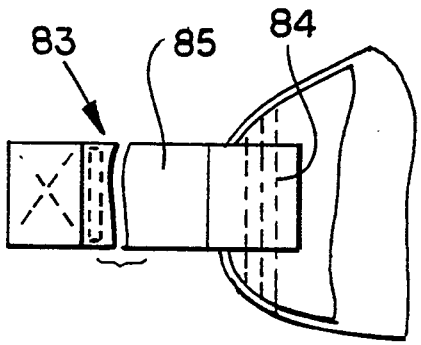

FIG. 11*a* is a view of a simplified alternative embodiment of the invention; FIG. 11*b* is another embodiment.

DETAILED DESCRIPTION OF THE INVENTION

Figure 1:
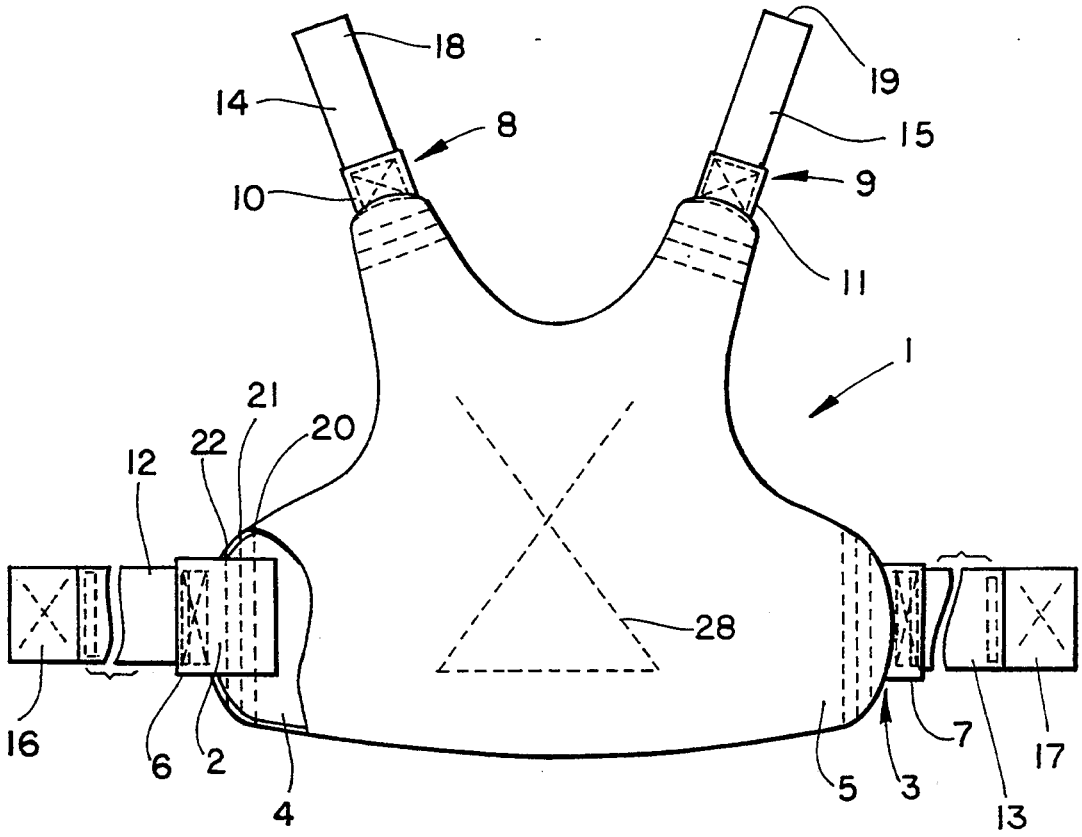
FIG. 1 is a front view of a body armor panel produced according to the present invention.

Referring to FIG. 1, a body armor panel 1 is shaped to correspond to and protect a wearer's upper torso. The body armor panel may be inserted into a vest like garment shell so that it can easily and comfortably be worn by an individual who needs ballistic protection. The body armor panel 1 is, in conventional fashion, formed of a plurality of discreet fiber plies. The fiber plies may be, for example, of two types, either woven aramid fibers or polyethylene fibers layed-up in orthogonal fashion. Typically, the polyethylene fibers are encased in a polyethylene fill to hold the fibers in place. Both the aramid plies and the polyethylene plies are known in the art and the assembly of these plies into a body armor panel, requiring inspection, cutting, and locating together, are also well known in the art.

The body armor panel 1 has first and second side fastener receivers 2 and 3 integral with the multi-layer panel. Each receiver is preferably produced of a strong fabric, such as nylon, which is formed into a pocket which extends into side portions 4 and 5 of the panel 1. Each receiver has a projecting portion 6 and 7 which extends beyond the edge of the armor panel. The panel also includes two shoulders receivers 8 and 9 which are similarly integral with the body armor panel, having projecting portions 10 and 11.

Each receiver projecting portion accepts a resilient strap 12, 13, 14, and 15 respectively, which is preferably resilient across a substantial portion of its length. A portion of each resilient strap may be non-resilient. For example, a nominal two inch wide strap having an elastomer core which provides about 90% manual elongation with ±10% (80–100%) may be used at the shoulders, and a similar nominal four inch strap used at the sides. Of course, other materials with differing sizes and elongations may be used. Such materials are commercially available, such as from George C. Moore Co. Westerly, R.I.

Each resilient strap has a separable fastener 16, 17, 18, and 19 located on an outward portion thereof. Various separable fasteners may be used, with VELCRO separable hook and loop fasteners preferred, either a hook end or loop end provided for attachment to corresponding loop end or hook end fasteners disposed elsewhere on the garment. Each strap extends sufficiently to allow engagement with a corresponding fastener to allow some adjustment for individual wearer differences, in all cases allowing for some stretch of the resilient straps when the fasteners are engaged.

The receiver 2 is retained within the armor panel by three through stitches 20, 21 and 22 which extend through all the ballistic layers and the integral receiver. The other receivers 3, 8, and 9 are attached in a similar fashion. Preferably, multiple linear stitches (two or more) are used to increase ballistic resistance and to strengthen the attachment. These stitches extend for at least the width of the receiver, and preferably extend beyond the width of the receiver to a substantial degree, most preferably extending from end to end along the side and shoulder portions.

Figure 2:
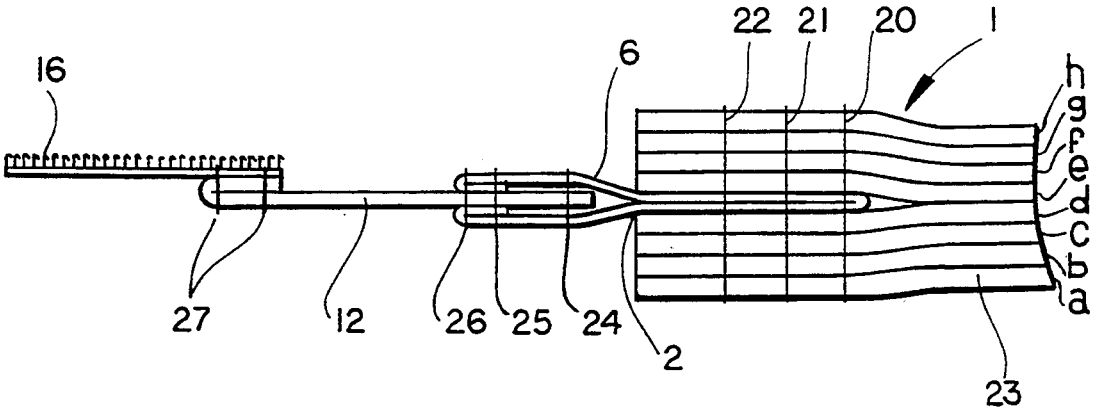
FIG. 2 is an enlarged cross-sectional view showing an integral fastener assembly.

Referring to FIG. 2, a cross-sectional view of the receiver attachment is shown. The body armor panel 1 has, for illustrative purposes, 8 ballistic layers 23*a–h*. Between the layers d and e of ballistic material, is incorporated the receiver 2 which has the three stitches 20, 21 and 22 extending through all the layers and the receiver to hold the receiver in position. The resilient strap 12 is similarly held by stitches 24, 25 and 26 in the receiver projecting portion 6. The fastener 16, shown as a VELCRO TM hook and loop fastener pad, is attached to the strap by stitches 27. Of course, other means for attaching the fastener to the strap, such as adhesives, may be used. The type of stitching used is a matter of choice and a box stitch or multiple linear stitches are equally acceptable. Both shoulders and the other side fastener are constructed in the same way. Additionally, the armor panel 1 has, for example, a cross stitch 28 centrally located to maintain the ballistic layers in register and also to add some stiffness to the panel.

When the body armor panel is fixed to the body, each of the four straps is pulled and stretched before fastening to assure that the body armor panel is tensioned such that upon impact, the layer displacement to the point of impact is counteracted by the resilient straps. Since the panel is resiliently maintained on the body, when subjected to successive impacts, the resilient nature of the attachment assists in pulling the panel back to its prior configuration to maximize surface area coverage on the body, thus maximizing ballistic protection.

Figure 3:
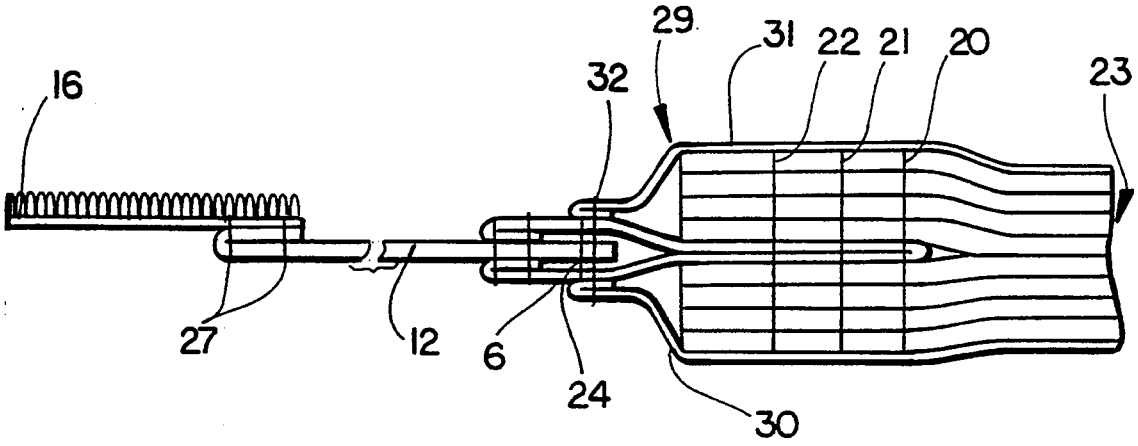
FIG. 3 is an enlarged cross-sectional view of an alternative embodiment body armor panel using an additional nylon shell.

Referring to FIG. 3, an alternative embodiment of the present invention is shown. A nylon outer jacket 29 is placed over the body armor panel made up of the ballistic layers 23. The jacket 29 has an inner layer 30 and an outer layer 31, the layers stitched together about the outer periphery independently of the armor panel. However, the layers 30 and 31 are attached to the fastener through a stitch 32 which extends through the receiver outer portion 6 and the strap 12.

This provides an additional attachment of the body armor panel to the resilient strap in the event that the internal stitches 20, 21 and 22 fail in holding the receiver. The stitch 32 holding the nylon jacket to the receiver thus acts as a redundant attachment to keep the fastener integral with the armor, as the jacket stitches are outboard of the body armor panel and thus less susceptible to impact damage.

Figure 4:
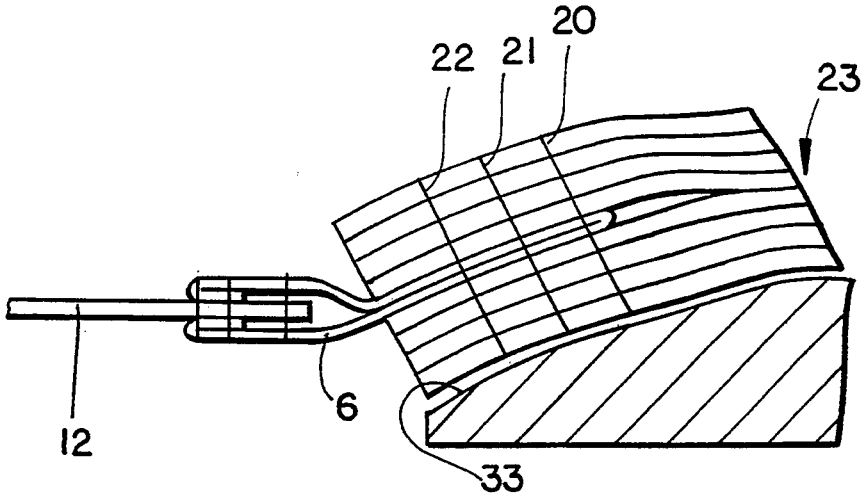
FIG. 4 is an enlarged cross-sectional view of an alternative embodiment including shaped layer portions defined by the receiver attachment stitches.

Referring to FIG. 4, an additional feature of the present invention is that the stitches 20, 21 and 22, used to incorporate the receiver within the body armor panel, can be used to shape the shoulder and side portions to provide a more contoured fit to the body to increase user comfort. While the tensioning arrangement of the invention may exert some force tending to pull straight side and shoulder portions into the body, the multiple stitches tend to resist this force, which can affect comfort. The ballistic plies 23*a–h* are first shifted relative to each other by shaping over a contoured surface 33. Two or more stitches are then added which hold the layers in this registered form to approximate the natural body contour. Contouring the side and shoulder portions thus provides a more comfortable panel for the user. Optimally, four linear stitches are used, spaced apart in an amount sufficient to spread the contouring effect over the side and shoulder portions. Generally, a spacing of 0.25–0.75 inch may be used, though other spacings would surely be acceptable. Of course, additional stitches also provide a stronger attachment, with the spacing between stitches lessening the likelihood of a projectile striking more than one stitch.

The body armor panels of the invention are typically incorporated into a garment shell.

Figure 5:
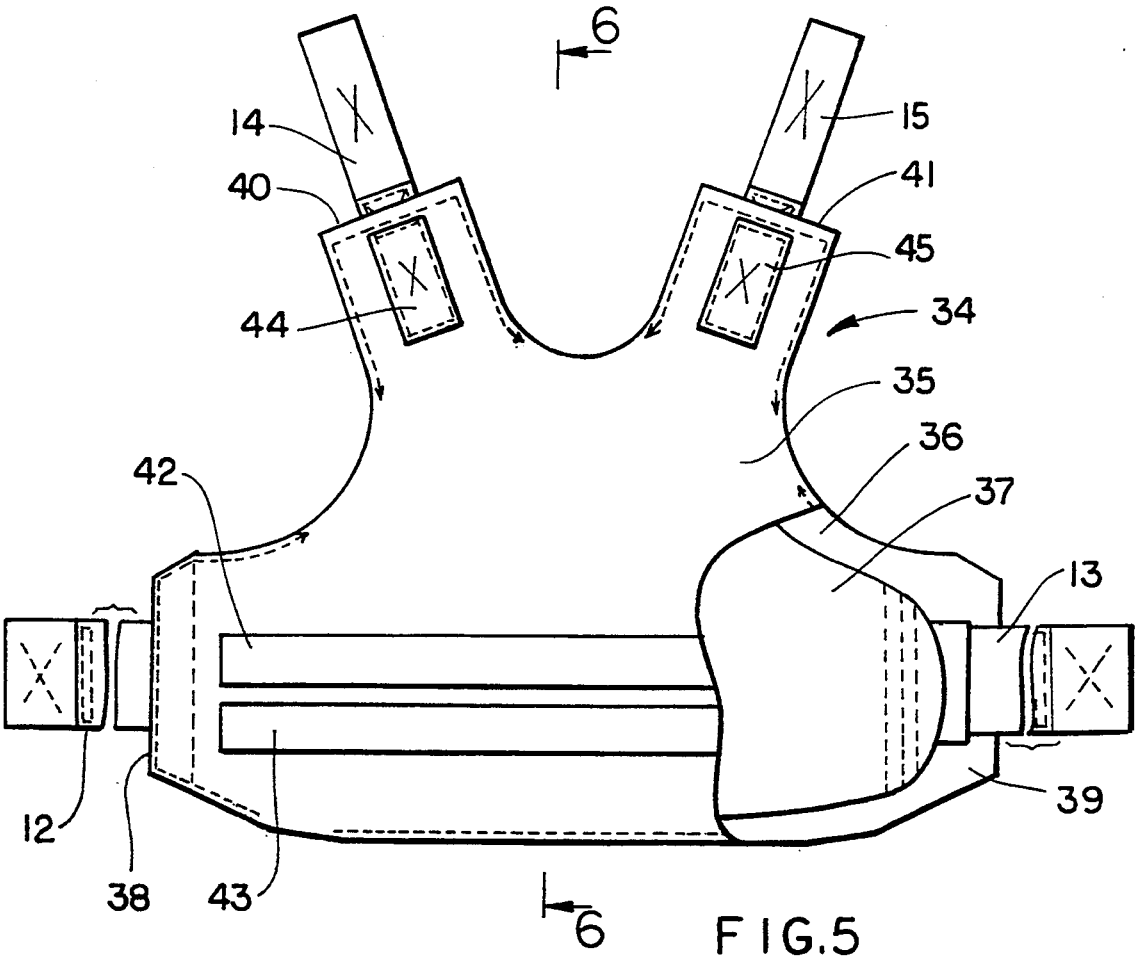
FIG. 5 is a view of a front garment shell within which the inventive body armor panel is located.

Referring to FIG. 5, a front garment shell 34 for retaining the body armor panel 1 has an outer layer 35, an inner layer 36, and a pocket 37 therebetween within which the body armor panel is disposed. Passages 38, 39, 40, and 41 are provided at each side and at each shoulder for the straps 12, 13, 14, and 15 to exit from the garment shell. The outer layer 35 has complementary fastener means 42, 43, 44, and 45 for accepting mating fasteners which extend from a complementary back body armor panel, as described below.

Figure 6:
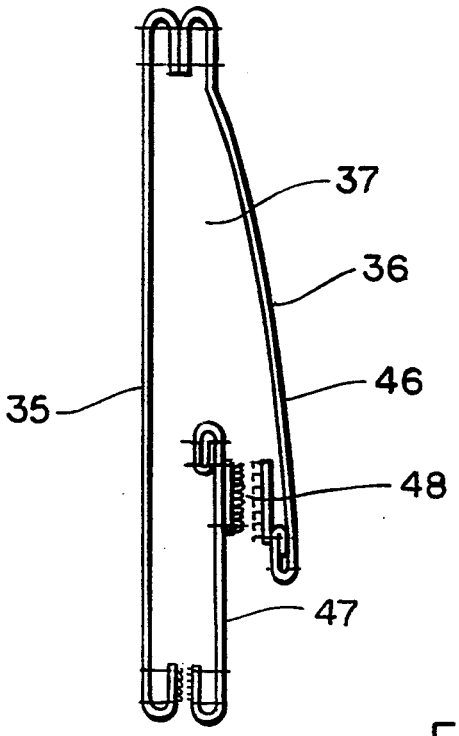
FIG. 6 is a view taken along line 6—6 of FIG. 5

Referring to FIG. 6, a cross-sectional view taken through line 6—6 of FIG. 5 is shown. The outer and inner layers 35 and 36 form the pocket 37 with the inner layer having an upper portion 46 and a lower portion 47 with a separable fastener 48 therebetween which allows insertion or removal of the ballistic panel in the pocket.

Figure 7:
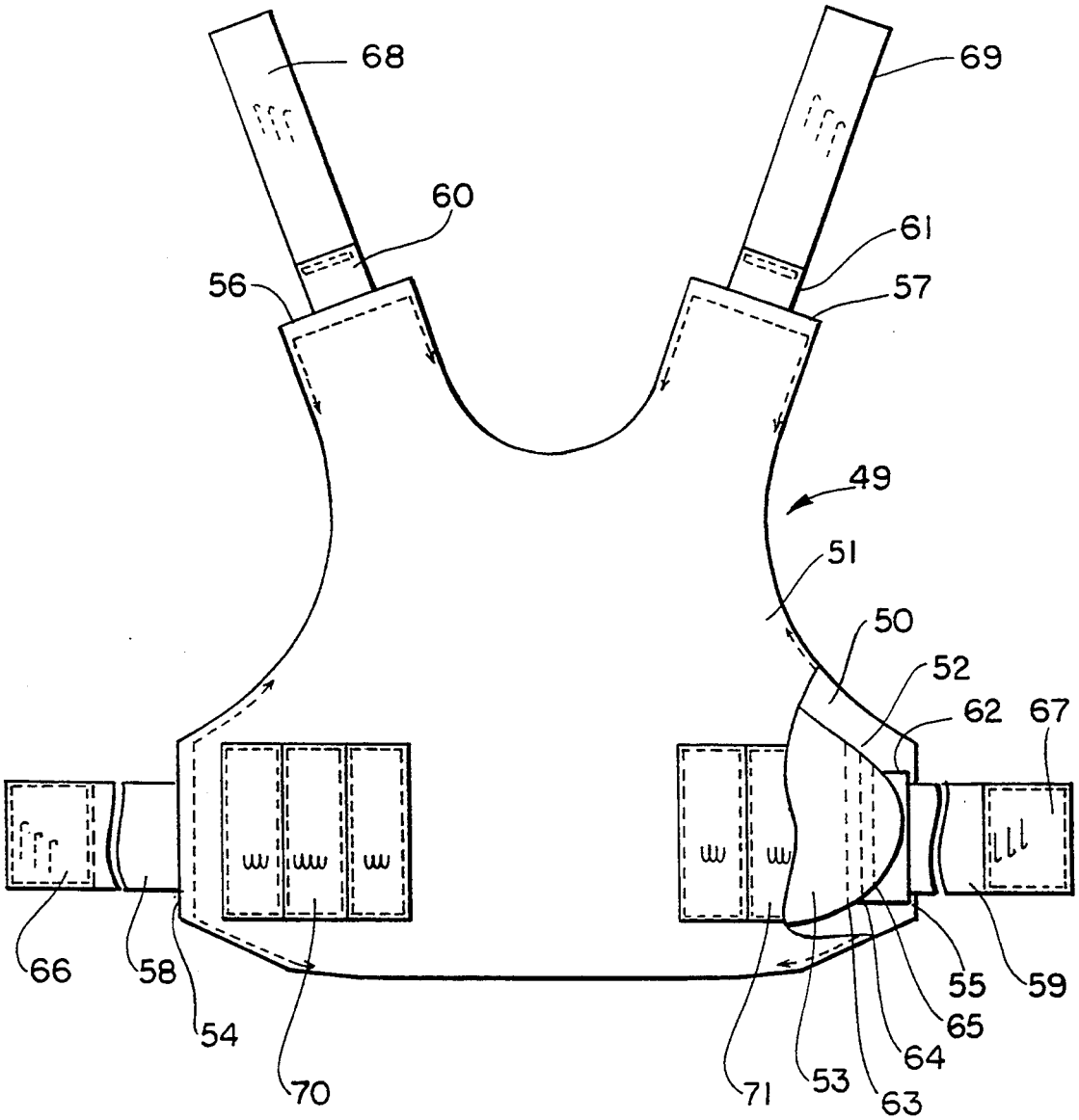
FIG. 7 is a view of a back garment shell usable with the garment shell of FIG. 5.

Referring to FIG. 7, a complementary back garment shell 49, though of somewhat different shape, is constructed similarly to the front garment shell, having an inner layer 50 and an outer layer 51 which define a pocket 52 within which a body armor panel 53 is disposed. The back garment shell 49 has passages 54, 55, 56, and 57 at the sides and shoulders through which straps 58, 59, 60, and 61 extend. The back body armor panel is constructed similarly to the front armor panel, having receivers 62 and stitches 63, 64 and 65 as previously described. Four resilient straps 66, 67, 68 and 69 are attached to the panel, with the other side and shoulder assembles constructed in similar fashion. The back garment shell additionally has fastener means 70 and 71 for accepting mating fasteners which extend from the front armor panel.

Figure 8:
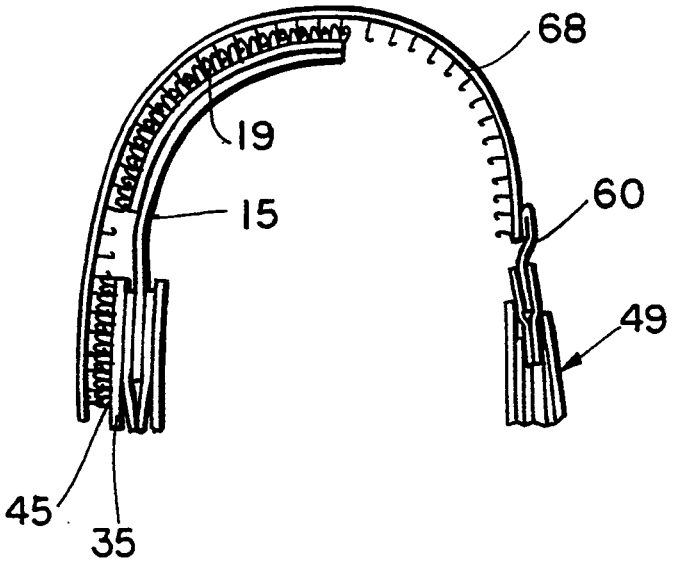
FIG. 8 is a side view of the mating of the front and back garment shells of FIGS. 5 and 7, over the shoulders.

Referring to FIG. 8, the shoulder attachments between the front and rear body armor panels are shown. The back panel strap 60 and fastener 68 extend from the back garment shell and overlay the shoulder to engage the fastener 45 disposed on the front garment shell outer layer 35. Additionally, the front panel strap 15 is pulled backwards and is engaged by fastener 19 to the fastener 68 to assure that the front and back armor panels are integral in terms of force distribution and tensioned properly.

Figure 9:
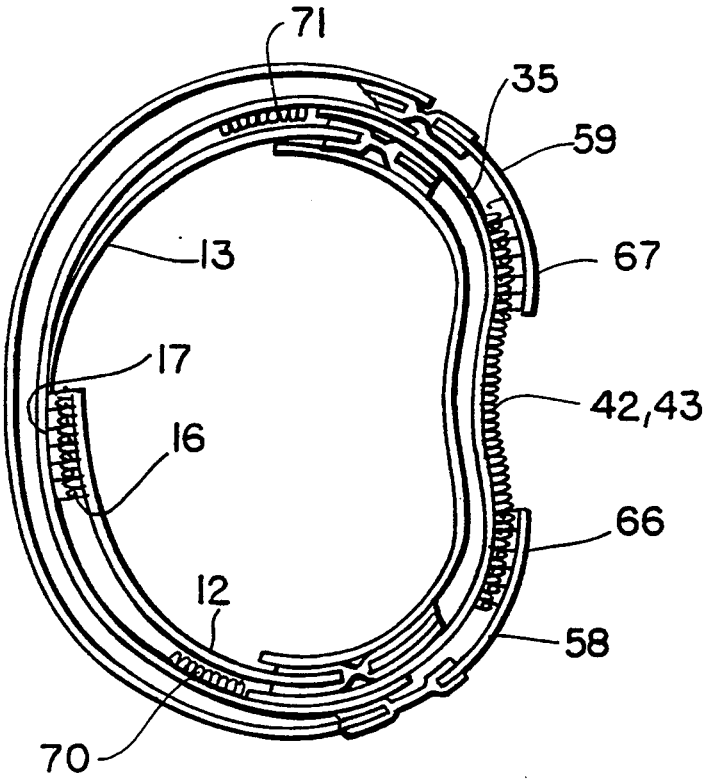
FIG. 9 is a cross-sectional view of the mating of the front and back garment shells of FIGS. 5 and 7, around the waist.

Referring to FIG. 9, the attachment of the side fasteners in a cumberbun fashion is shown. The front panel straps 12 and 13 pass around the waist and have facing fasteners 16 and 17 which attach at the back. After attachment, the back panel side straps 58 and 59 are pulled over the front panel outer layer 35 and the fasteners 66 and 67 are attached to the fastener strips 42 and 43. Alternatively, the back panel inner layer fasteners 70 and 71 attach to the fasteners 16 and 17, if a cumberbun arrangement is not desired. In either case, the front and rear armor panels are tensioned in both the upward and sideward directions so any impact on either armor panel, while instantaneous pulling the ballistic material inward to the point of impact, will return substantially to its previous shape due to the action of the resilient straps.

Figure 10:
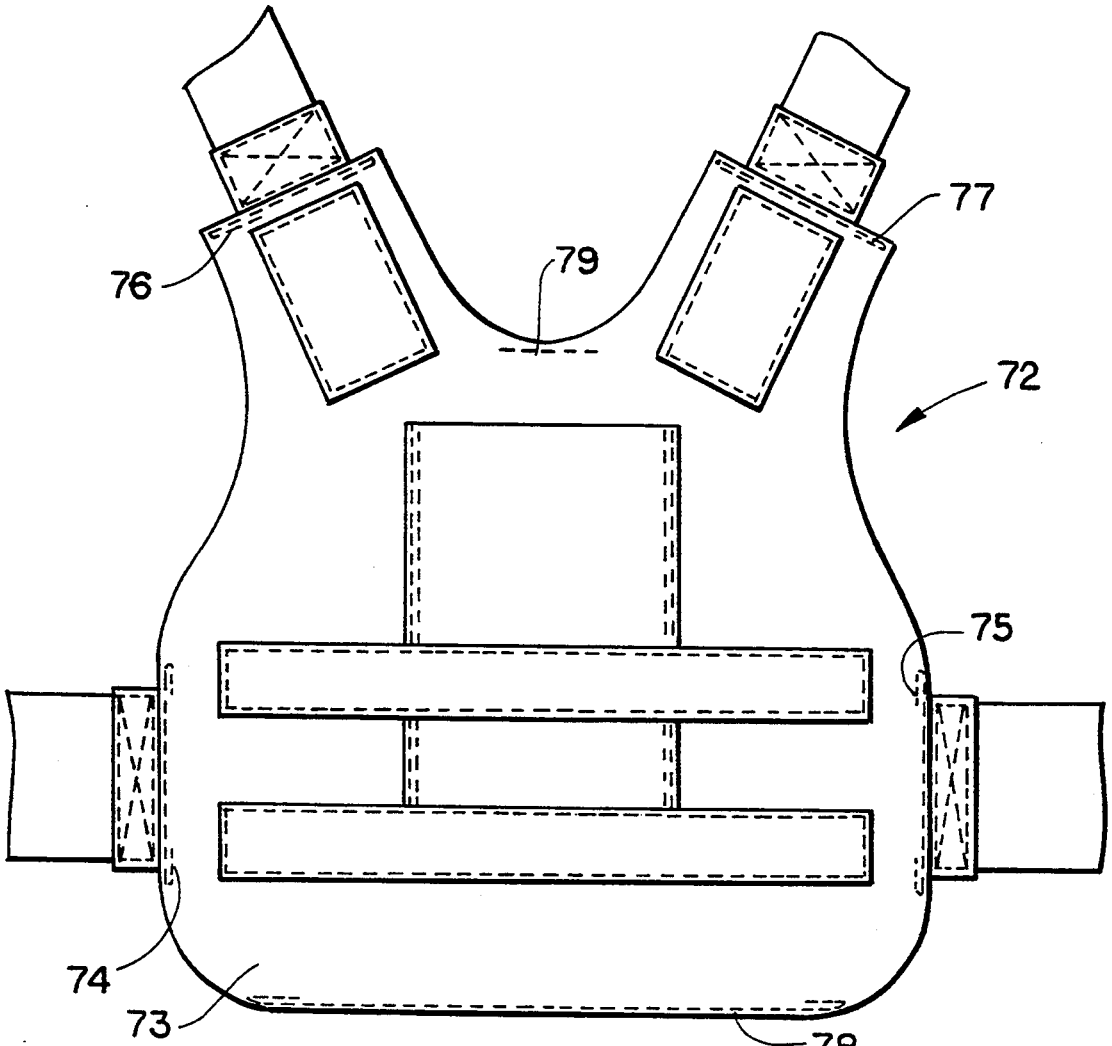
FIG. 10 is a view of an alternative embodiment of the invention.

Referring to FIG. 10, an alternative embodiment of the present invention is shown. An armor panel 72 has an integral non-removable outer shell 73 permanently attached by stitches 74, 75, 76 and 77 to the underlying multiple layers of ballistic material. These are in addition to the receiver stitches. The outer shell may be made from a 420 Denier nylon or another fabric. The receivers and fasteners are constructed in accordance with the invention as described above. The only difference between this and previous embodiments of the invention is that the outer shell is integral with the armor panel and is not removable. Such armor may be used, for example, in tactical situations where concealment of the body armor is not critical. This armor panel uses additional linear stitching 78 and 79 to assist in keeping the ballistic layers in register, to avoid reliance solely on the side and shoulder receiver stitches.

Referring to FIG. 11*a*, another alternative embodiment of the invention is shown. A body armor panel 80, constructed in accordance with the panel of FIG. 1, has a resilient strap 81, having a portion 82 extending into the armor panel, rather than relying on a receiver as described previously. This simplifies the construction of the body armor panel, while still providing a tensioned panel for shape recovery. An advantage of the receiver is that it allows strap replacement or exchange, without disturbing the panel stitches. FIG. 11*b* shows a similar alternative embodiment, where a strap 83 has a non-resilient portion 84, possibly made of nylon, located within the interior of the armor panel, and a resilient portion 85 which extends outwardly from the armor panel. This alternative allows prior construction of the composite strap, before incorporation into the armor panel. Again, the objectives of the invention are achieved by the resilient strap portion. Of course, these constructions are applicable to both the side and shoulder portions.

It should be understood by those skilled in the art that the attachment described in relation to FIGS. 8 & 9 can be reversed, as the straps described as exiting from the front armor panel could just as easily exit from the rear armor panel. This is simply a matter of design choice, or wearer preference, and the description of the fastener attachment sequence is not unique. Similarly, the cumberbun type strapping arrangement can extend from the back panel for engagement over the stomach with the front panels fasteners attached to VELCRO hook and loop fastener strips on the outer layer of the back garment shell. In either event, the results are the same as the body armor panels are sufficiently tensioned to assure that successive impacts which cause bunching of the armor layers are absorbed, with the tension pulling the layers substantially back to their previous shape to maximize surface area protection.

Ballistic tests were performed on the inventive body armor panel with the result that even after 20 successive shots (44 magnum projectile, copper jacketed) that about 95% of the original surface area continued to be covered by the ballistic layers. When similar testing was undertaken with a conventional armor panel inserted loosely in a garment shell, the protected surface area reduced to less than 90%.

While preferred embodiments of the present invention have been shown and described, it will be understood by those skilled in the art that various changes and modifications could be made without varying from the scope of the present invention.

What is claimed is:

1. A body armor panel for covering a first portion of a wearer's body comprising multiple layers of ballistic resistant material, the panel having projecting side portions and shoulder portions, resilient strap means located at the side and shoulder portions, and wherein the resilient strap means have first ends integral with the ballistic layers and second ends extending from the panel to tension the armor panel sufficiently to provide substantial return to its original shape after an impact, first attachment means located at the side and shoulder portions for securing the resilient strap means sandwiched within the multiple ballistic layers, separable fastener means attached to the second strap ends and, complementary separable fasteners located about a wearer's body for engagement with the separable fastener means for securing the panel to the wearer's body.

2. The body armor panel of claim 1 further comprising receiver means integral with the ballistic layers and disposed intermediate thereof at the side and shoulder portions, the receiver means having a portion projecting beyond an edge of the armor panel for accepting the first strap ends therein, the first attachment means securing the resilient strap means within the multiple ballistic layers, second attachment means securing the resilient strap means to the receiver means.

3. The body armor panel of claim 1 wherein the first attachment means comprise two or more linear stitches extending vertically for at least the width of the strap means.

4. The body armor of claim 1 wherein the side and shoulder armor panel portions are shaped in a body contour.

5. The body armor of claim 1 further comprising a jacket having an inner layer and an outer layer which substantially envelop the armor panel, stitch means disposed about a periphery of the inner and outer layers for attaching the inner and outer layers to each other, outside a periphery of the ballistic layers, the stitch means attaching the inner and outer layers through the resilient strap means.

6. The body armor panel of claim 5 wherein the jacket layers are composed of nylon.

7. The body armor panel of claim 1 further comprising a jacket having an inner layer and an outer layer which envelop the armor panel, stitch means disposed about a periphery of the inner and outer layers for attaching the layers to each other, within a periphery of the ballistic layers, the stitch means attaching the layers through the resilient strap means and ballistic layers.

8. The body armor panel of claim 1 wherein the resilient strap means are non-resilient for a portion thereof.

9. The body armor panel of claim 1 further comprising a second body armor panel for covering a second portion of a wearer's body, the complementary separable fastener means disposed thereon for securing the first panel thereto.

10. The body armor panel of claim 1 further comprising a second body armor panel for covering a second portion of a wearer's body, the second body armor panel having multiple layers of ballistic resistant material, the second panel having projecting side portions and shoulder portions, resilient strap means located at the side and shoulder portions, and wherein the resilient strap means have first ends integral with the ballistic layers and second ends extending from the second panel to tension the second armor panel sufficiently to provide substantial return to its original shape after an impact, first attachment means located at the side and shoulder portions for securing the resilient strap means within the multiple ballistic layers, separable fastener means attached to the second strap ends, the second panel having the complementary separable fastener means disposed thereon for securing the body armor panel thereto, second complementary separable fastener means located on the body armor panel for engagement with the separable fastener means of the second panel for attaching the second panel thereto, to secure both panels to the wearer's body.

11. The body armor panel of claim 1 further comprising a garment shell having an inner layer, an outer layer, a pocket formed therebetween for accepting the body armor panel therein, and having passages at the sides and shoulders thereof through which the resilient straps means extend.

12. The body armor panel of claim 10 further comprising a second garment shell having an inner layer, an outer layer, a pocket formed therebetween for accepting the second body armor panel therein, and having passages at the sides and shoulders thereof through which the resilient straps means of the second body armor panel extend.

13. The body armor panel of claim 1 wherein the side resilient strap means extend around the wearer and are engagable with each other, to hold the panel against the body.

14. The body armor panel of claim 10 wherein the separable fastener means extending from the body armor panel and the separable fastener means extending from the second body armor panel are engageable with each other.

15. A method for providing protection from successive ballistic impacts comprising:

providing a body armor panel having multiple layers of ballistic resistant material, the panel having projecting side portions and shoulder portions, resilient strap means located at the side and shoulder portions, and wherein the resilient strap means have first ends integral with the multiple ballistic layers and second ends extending from the panel to tension the armor panel sufficiently to provide substantial return to its original shape after an impact, first attachment means located at the side and shoulder portions for securing the resilient strap means sandwiched within the multiple ballistic layers, separable fastener means attached to the second strap ends and, complementary separable fasteners located about a wearer's body for engagement with the separable fastener means for securing the panel to the wearer's body;

placing the body armor panel on the wearer's body;

stretching the side and shoulder resilient strap means; and attaching the separable fastener means on the strap means to the complimentary fasteners, tensioning the body armor panel in the sideward and upward directions, to provide substantial shape recovery after successive ballistic impacts.

* * * * *